United States Patent [19]

Robertson

[11] Patent Number: 5,066,519

[45] Date of Patent: Nov. 19, 1991

[54] JET WIPING NOZZLE

[75] Inventor: Malcolm A. Robertson, East Maitland, Australia

[73] Assignee: Australian Wire Industries Pty. Limited, Sydney, Australia

[21] Appl. No.: 392,103

[22] Filed: Aug. 10, 1989

[30] Foreign Application Priority Data

Aug. 24, 1988 [AU] Australia ..... PJ0032

[51] Int. Cl.[5] ..... B05D 3/04

[52] U.S. Cl. ..... 429/349; 427/432; 118/63

[58] Field of Search ..... 427/348, 349, 432, 433; 118/420, DIG. 19, 63

[56] References Cited

U.S. PATENT DOCUMENTS

| | | | |
|---|---|---|---|
| 2,194,565 | 3/1940 | Moss | 15/269 |
| 3,060,889 | 10/1962 | Knapp | 118/63 |
| 3,270,364 | 9/1966 | Steele | 15/306 |
| 3,459,587 | 8/1969 | Hunter et al. | 117/102 |
| 3,533,761 | 10/1970 | Pierson | 118/63 |
| 3,607,366 | 9/1971 | Kurokawa | 427/349 |
| 3,611,986 | 10/1971 | Piersee | 118/63 |
| 3,681,118 | 8/1972 | Ohama et al. | 118/63 X |
| 3,707,400 | 12/1972 | Harvey et al. | 117/102 L |
| 3,736,174 | 5/1973 | Moyer | 117/102 M |
| 4,287,238 | 9/1981 | Stavros | 427/349 |

FOREIGN PATENT DOCUMENTS

| | | |
|---|---|---|
| 421751 | 9/1970 | Australia . |
| 458892 | 8/1971 | Australia . |
| 462301 | 7/1973 | Australia . |
| 0537944 | 10/1981 | Australia . |
| 1446861 | 8/1976 | United Kingdom . |
| 2010917 | 7/1979 | United Kingdom . |

*Primary Examiner*—Shrive Beck
*Assistant Examiner*—Alain Bashore
*Attorney, Agent, or Firm*—Poms, Smith, Lande & Rose

[57] ABSTRACT

The surface appearance of a wire or tube coated with a liquid metal may be improved by the use of a gas jet wiping nozzle of defined shape to wipe excess molten metal from the wire or tube. The nozzle has an upper annular part and a lower annular part, each of the annular parts has an upper and a lower annular surface meeting in an annular edge. Adjacent surfaces of the upper and lower annular parts define between them an annular gas passage terminating in an annular gas orifice adapted to surround a wire or tube being wiped. The included angle between the upper surface of the upper annular part and the direction of travel of gas leaving the gas orifice being smaller than $(80-x)^\circ$ and the included angle between the lower surface of the lower annular part and the direction of travel of gas leaving the gas passage being smaller than $(70+x)^\circ$ where x is the included angle between a plane normal to the direction of movement of the wire or tube through the gas jet wiping nozzle and the direction of travel of gas leaving the gas passage. The lower surface of the lower annular part directly faces the liquid bath and is so disposed that the minimum included angle between that surface and the direction of movement of the wire or tube through the gas jet wiping nozzle is at least 20°. The upper surface of the upper annular part is so disposed that the minimum included angle between the surface and the direction of movement of the wire or tube through the gas jet wiping nozzle is at least 10°.

24 Claims, 1 Drawing Sheet

JET WIPING NOZZLE

TECHNICAL FIELD

The present invention relates to an improved process for the jet wiping of metallic filaments of material which have been dip coated in a liquid metal bath, to apparatus for carrying out such a process and to a jet wiping nozzle for inclusion in such an apparatus.

BACKGROUND ART

When filaments of material, such as metal wire or strip, are dip coated, for instance in molten zinc, aluminum or their alloys, it is normally necessary to strip excess coating material from the surface of the filament. There are a number of known ways of achieving this, one of which is generally called gas jet wiping. In gas jet wiping processes a stream of a gas is caused to impinge upon the filament to strip the excess coating material therefrom. Typical jet wiping apparatus and nozzles therefore are described in the following patent specifications:

| | |
|---|---|
| U.S. | 2,194,565 |
| | 3,060,889 |
| | 3,270,364 |
| | 3,611,986 |
| | 3,707,400 |
| | 3,736,174 |
| | 4,287,238 |
| Australian | 458,892 |
| | 537,944 |
| | 539,396 |
| | 544,277 |

In coating filaments by the known gas jet wiping processes, and in particular in the coating of ferrous wire with molten metals such as zinc, aluminum or their alloys, a number of problems arise.

For planar material such as metal sheet, gas jet wiping has been effective in controlling the thickness of the coating metal on the material and in producing a smooth uniform surface finish. For angular filaments such as circular and non-circular wire, tubular material and narrow strip the geometry of the material being wiped presents problems not occurring with planar material. Metal oxide builds up on the filament beneath the wiping region and forms a ring or band around the complete perimeter of the filament. Periodically this build up of oxide becomes sufficient to burst through the wiping gas stream, because of the filament's small circumference, to form thick rings or bands of coating on the filament, which is undesirable. The present invention is directed towards overcoming this problem.

A number of prior art gas jet wiping processes have overcome this problem by enclosing the filament within a hood which provides a completely protective atmosphere to the filament between when it leaves the metal bath and when it is wiped, such as is outlined in U.S. Pat. Nos. 3,707,400 and 4,287,238.

A problem with the process disclosed in U.S. Pat. No. 3,707,400 is that it has been difficult or impossible to control the thickness of the coating metal on the filament by adjusting the quantity of gas entering the gas jet wiping nozzle. In order to alter the coating thickness without changing to a different sized nozzle, it has been necessary to alter the throughput speed of the filament directly proportional to the thickness of coating required, i.e. decreased coating thicknesses require decreased throughput speeds and increased coating thicknesses require increased throughput speeds. This requirement to adjust the throughput speed of the filament in order to obtain a desired coating thickness, is undesirable as it impedes the efficient operation of other sections of a galvanising line e.g. the heat treatment and cleaning sections and changes the quantity of wire produced.

A problem with the process disclosed in U.S. Pat. No. 4,287,238 is that splatterings of coating metal form on the surface of the nozzle's wire orifice, especially at higher wiping gas pressures and filament speeds. These splatterings, which have been removed from the filament as a consequence of the wiping action, are a problem, because they build up quickly on the surface of the nozzle's wire and gas orifices and eventually come into contact with the filament, interfere with the effective wiping action of the gas and cause surface imperfections on the filament. A further problem with this process is the relatively large quantities of gas consumed, which make it more economical to use alternative wiping processes such as pad wiping, where the filament is physically wiped by asbestos or similar material or the process as outlined in U.S. Pat. No. 3,892,894.

A still further problem with the process according to U.S. Pat. No. 4,287,238 is the relatively large overall dimensions of the wiping apparatus. Its overall size means that wires must be spaced further apart at the exit end of the hot dip metal bath than would otherwise be the case and as such, fewer wires can be processed, resulting in reduced production. A variation of this process, as outlined in Australian patent specification 539396, where the gas jet wiping is carried out without a protective hood, suffers from the problems described above in connection with the process of U.S. Pat. No. 4,287,238, and additionally with the problem of thick coating rings remaining on the filament after being wiped, also mentioned above. The present invention is directed towards overcoming the abovementioned deficiencies in known gas jet wiping processes and the apparatus used to carry this out.

U.S. Pat. No. 3,736,174 discloses a gas jet wiping nozzle having a plurality of gas streams which are caused to impinge upon each other prior to striking the filaments being wiped. This arrangement allows the angle of impingement of the gas on the filament to be varied. While parts of the nozzle bear a superficial resemblance to the nozzle according to this invention, the nozzle according to this specification, when taken as a whole, does not show the physical configuration which produces the desirable qualities of the nozzle according to the present invention.

DISCLOSURE OF THE INVENTION

In a gas jet wiping process for controlling the film applied from the dip coating of a metal filament through a liquid metal bath, a first aspect of the present invention comprises the improvement of an annular gas jet wiping nozzle having an upper annular part and a lower annular part, each of the annular parts having an upper and a lower annular surface meeting in a substantially sharp annular edge, adjacent surfaces of the upper and lower annular parts defining between them an annular gas passage terminating in an annular gas orifice, the edges and the gas orifice defining a filament orifice through which the filament passes, the included angle between the upper surface of the upper annular part and the direction of travel of gas leaving the gas orifice being smaller than (80−x)° and the included angle between the lower surface of the lower annular part and the direction of travel of gas leaving the gas passage being smaller than (70+x)° where x is the included angle between a plane normal to the direction of movement of the filament through the gas jet wiping nozzle and the direction of travel of gas leaving the gas passage, the lower surface of the lower annular part directly facing the liquid bath and being so disposed that the minimum included angle between that surface and the direction of movement of the filament through the gas jet wiping nozzle is at least 20°, and the upper surface of the upper annular part being so disposed that the minimum included angle between the surface and the direction of movement of the filament through the gas jet wiping nozzle is at least 10°.

In a second aspect the present invention consists in an apparatus for continuously applying and controlling the thickness of a film applied from the dip coating of a metal filament through a liquid metal bath, comprising:

a) a liquid metal coating bath, b) a source of pressurised gas, and c) a gas jet wiping nozzle having an upper annular part and a lower annular part each of the annular parts having an upper and a lower surface meeting in a substantially sharp annular edge, adjacent surfaces of the upper and lower annular parts defining between them an annular gas passage operatively connected to the source of pressurised gas and terminating in an annular gas orifice, the edges and the gas orifice defining a filament orifice through which passes a filament being wiped, the included angle between the upper surface of the upper annular part and the direction of travel of gas leaving the gas orifice being smaller than (80−x)° and the included angle between the lower surface of the lower annular part and the direction of travel of gas leaving the gas passage being smaller than (70+x)° where x is the included angle between a plane normal to the direction of movement of the filament through the gas jet wiping nozzle and the direction of travel of gas leaving the gas passage, the lower surface of the lower annular part directly facing the liquid bath and being so disposed that the minimum included angle between that surface and the direction of movement of the filament through the gas jet wiping nozzle is at least 20°, and the upper surface of the upper annular part being so disposed that the minimum included angle between the surface and the direction of movement of the filament through the gas jet wiping nozzle is at least 10°.

In a third aspect the present invention consists in a gas jet wiping nozzle for use in controlling the film applied from the dip coating of a filament through a liquid bath, the nozzle having an upper annular part and a lower annular part, each of the annular parts having an upper and a lower annular surface meeting in a substantially sharp annular edge, adjacent surfaces of the upper and lower annular parts defining between them an annular gas passage terminating in an annular gas orifice, the edges and the gas orifice defining a filament orifice which in use will surround a filament being wiped, the included angle between the upper surface of the upper annular part and the direction of travel of gas leaving the gas orifice being smaller than (80−x)° and the included angle between the lower surface of the lower annular part and the direction of travel of gas leaving the gas passage being smaller than (70+x)° where x is the included angle between a plane normal to the direction of movement of the filament through the gas jet wiping nozzle and the direction of travel of gas leaving the gas passage, the lower surface of the lower annular part being adapted to directly face a liquid bath through which the filament is being passed and being so disposed in use that the minimum included angle between that surface and the direction of movement of the filament through the gas jet wiping nozzle is at least 20°, and the upper surface of the upper annular part being so disposed that the minimum included angle between the surface and the direction of movement of the filament through the gas jet wiping nozzle is at least 10°.

Preferred embodiments of the invention, when used in connection with the zinc, aluminum or aluminum/zinc alloy coating of ferrous filaments have the following advantages over the prior art:

1) Wiping efficiency of the nozzle according to the present invention is significantly higher than that of prior art designs with the result that much lower wiping gas pressure and volume is required for a given metal coating weight. Because the wiping gas can represent quite a significant component of total operating costs this is a worthwhile advantage.

2) Prevention of thick coating rings from remaining on the filament subsequent to the wiping operation is superior using the nozzle according to this invention, particularly at lower coating speeds and higher coating thicknesses, where wiping gas pressure is low.

3) Zinc splattering onto the surface of the nozzle's wire orifice and gas orifice is prevented.

4) The relationship between the wiping gas pressure and the coating thickness on the filament using the nozzle according to the present invention is such that coating thickness is directly controllable and adjustable, by altering the gas pressure, to a high degree of accuracy and precision.

5) Because the nozzle according to the present invention may have a small diameter wire orifice, a gas passage length merely sufficient to evenly distribute the gas around the gas orifice and no protective hood or chamber, the overall size of the nozzle is significantly smaller.

As used in this specification the term "filament" is taken to mean wire, both circular and non-circular in cross-section, narrow strip material having a width no more than 10 times its thickness and tubular material. The non-circular wire may be angled in cross-section. The invention is hereinafter principally described with reference to circular wires however it is stressed that the invention may also be applied to non-circular wires and the abovementioned strip material.

As used in this specification the "direction of travel of gas leaving the gas passage" may for convenience in many cases be regarded as the notional centre line defined between the upper surface of the lower annular part of the lower surface of the upper annular part when seen in radial section through the nozzle. The shape of the gas passage is preferably such that the lower surface of the upper part and the upper surface of the lower part are converging in the direction towards the gas orifice. In order to direct the gas at a particular angle, the surfaces near the gas orifice are preferably made symmetric, when seen in radial section, about a linear notional centre line through the gas passage, which is angled in the desired direction. If the line is non-linear it may be desirable to actually measure the direction of travel of the gas as it leaves the gas duct. If the gas passage is internally subdivided by an additional annular die part or parts to form a plurality of gas passages from which gas streams emerge which impinge upon one another, as is described in U.S. Pat. No. 3,736,174, the direction of travel of the gas is the direction resulting after the gas streams have so impinged. If the direction of travel of the gas stream is normal to the direction of movement of the filament then the angle x will be 0°. If the direction of travel of the gas is directed against the direction of movement of the filament then the angle x will have a positive value whereas if the direction of travel of the gas is directed in the same direction as the direction of movement of the filament the angle x will have a negative value. The gas passage preferably directs gas from the gas orifice at an angle in the range ±60° to a plane normal to the direction of movement of the filament, more preferably in the range +60° to −30° and most preferably +45° to 0°.

The upper and lower parts of the nozzle each include an upper and a lower surface which upper and lower surfaces meet in a substantially sharp annular edge. The expression "a substantially sharp annular edge" is used to mean an edge formed by two surfaces meeting along a line or the situation in which the edge is truncated to have a thickness of not more than about 3 mm, preferably not more than 2 mm, or is rounded off with a radius of no more than about 2 mm, preferably no more than 1 mm. The angle between the lower surface of the lower nozzle part and the direction of travel of gas leaving the gas passage must be less than (70+x)°. The included angle of the upper annular part is preferably less than 80°, more preferably less than 50° and most preferably less than 40°. The angle between the upper surface of the upper nozzle part and the direction of travel of gas leaving the gas passage must be less than (80−x)°. The included angle of the lower annular part is preferably less than 70°, more preferably less than 50° and most preferably less than 40°.

The adjacent surfaces of the upper and lower parts i.e. the lower surface of the upper part and the upper surface of the lower part, define between them the gas passage terminating in the gas orifice. The gas orifice is thus defined between the annular edges of the upper and lower parts of the nozzle. The gas passage is connected to a source of a suitable jet wiping gas such as air or nitrogen. The gas pressure preferably includes an annular baffle ring to provide a constriction in the gas passage designed to ensure that there is an even gas pressure around the gas orifice. Preferably there are multiple gas entry sources, evenly spaced around the nozzle to further improve gas distribution around the gas orifice. It is highly desirable that the length of the gas passage in a radial direction, is merely sufficient to evenly distribute the gas around the gas orifice. The gas passage is preferably such that the lower surface of the upper annular part and the upper surface of the lower annular part converge towards one another as they approach the gas orifice, when viewed in cross sections, for a distance of at least 2 mm, and preferably at least 6 mm, immediately preceding the gas orifice.

It is preferable that the nozzle has a filament orifice which is such that there is a uniform clearance between the filament and the filament orifice which clearance is as small as possible consistent with the requirement that the wire does not come into contact with the edges of the annular die parts. The clearance between the filament and the filament orifice is preferably less than 10 mm and more preferably less than 7.5 mm and most preferably less than 4 mm. These preferred wire orifice clearance distances are considerably smaller than those of prior art jet wiping nozzles. It has been found that the use of smaller wire orifice clearances enables a smooth, uniform coating using less quantity of gas. The less lateral movement that the wire can be constrained to, whilst passing through the nozzle, the smaller the clearance of the wire orifice that can be allowed. A wire guide, through which the wire passes and which is only marginally larger in size than the wire, may be used to further restrict lateral wire movement. This guide is submerged in the molten metal bath and is aligned such that it is vertically beneath the nozzle orifice and coaxial with the wire. The use of such a wire guide enables further reduction in the size of the clearance between the filament and the nozzle's wire orifice.

In preferred embodiments of the invention the height of the gas jet wiping nozzle above the surface of the liquid in the bath should be as low as possible consistent with avoiding splashing of the liquid from the surface of the bath. Ideally the gas issuing from the nozzle will form a smooth depression or puddle on the surface of the liquid in the bath surrounding the filament as it is withdrawn from the bath without causing splashing of the liquid from the surface of the bath. If the nozzle is raised too far above the surface of the bath, wiping effectiveness is reduced and the surface quality of the filament deteriorates. In a typical application the gas orifice of the nozzle is preferably spaced from the surface of the liquid in the bath by a distance of from 10 to 200 mm, more preferably from 15 to 100 mm.

The width of the gas passage, and thus of the gas orifice may be altered by making the position of the upper and lower parts of the nozzle adjustable relative to one another axially of the gas jet wiping nozzle. In one preferred embodiment of the invention this adjustment is achieved by threadedly engaging the upper and lower parts such that their relative rotation will change the width of the gas passage. Any other means for varying the gas orifice width may also be used, for instance, one part may be axially slidable relative to the other or shims may be placed between the upper and lower die parts of the nozzle.

BRIEF DESCRIPTION OF THE DRAWINGS

Hereinafter given by way of example is a preferred embodiment of the invention described with reference to the accompanying drawings in which.

BEST MODE FOR CARRYING OUT THE INVENTION

Figure 1:
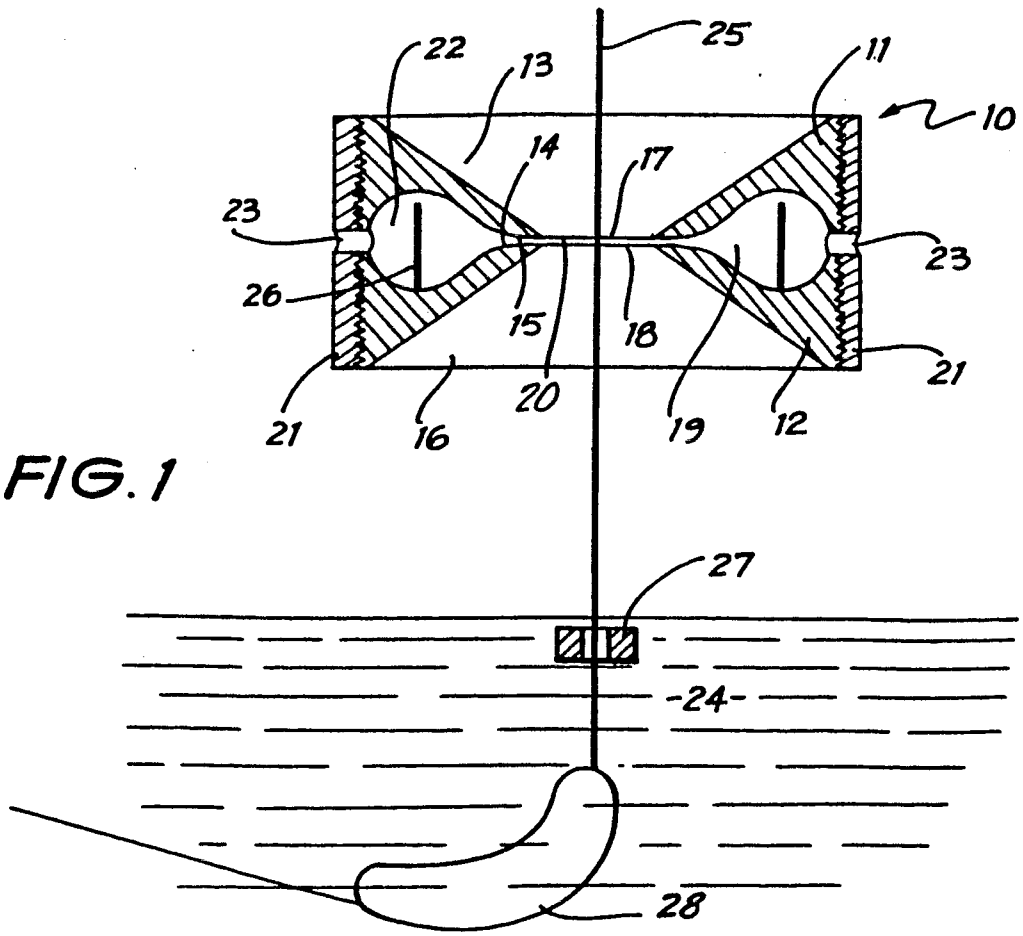
FIG. 1 is a cross-sectional view of a gas jet wiping nozzle according to the present invention.

The jet wiping nozzle 10 is adapted for use in connection with the galvanising of steel wire. The wire 25 is passed through a molten zinc bath 24 and drawn around a skid 26 and vertically through a wire guide 27 before passing through the jet wiping nozzle 10 positioned 20 mm above the surface of the zinc bath 24. After passing through the jet wiping nozzle 10 the galvanised wire is cooled on conventional cooling means (not shown).

The jet wiping nozzle 10 comprises an upper nozzle part 11 and a lower nozzle part 12. Each of the nozzle parts 11 and 12 has an upper face, 13 and 14 respectively, and a lower face, 15 and 16 respectively. These upper and lower faces meet in respective sharp circular edges 17 and 18. A gas passage 19 is defined between the faces 14 and 15 which terminates in an annular gas orifice 20. The centre line between the faces 14 and 15, near the gas orifice, lies in the horizontal plane normal to the wire. The angle between faces 13 and the centre-line is 35° and the angle between faces 16 and the centre line is 35°. The included angle between the wire 25 and each of the faces is 55°.

The upper and lower nozzle parts 11 and 12 are each threaded on their outer circumferences and are threadedly engaged with a nozzle body 21. The width of the gas passage 19 may be altered by relative rotation between one or both of the nozzle parts 11 and 12 and the body 21. The gas passage 19 communicates with a gas chamber 22 formed between nozzle parts 11 and 12 and body 21. Gas inlets 23 into the nozzle 10 pass through body 21 into gas chamber 22. A gas baffle 26 is positioned in the gas passage 19 to ensure an even flow of wiping gas from the gas inlet 23 to the gas orifice 20.

A gas, preferably a non-oxidising gas such as nitrogen, is introduced through gas inlets 23 from whence it flows through gas chamber 22 into annular gas duct 19. The gas flowing out of the duct 19 impinges on the wire 25 and wipes excess molten zinc from the wire 25 passing through the jet wiping nozzle 10.

In a typical process according to the present invention a 2.50 mm diameter steel wire was run vertically upwardly through the nozzle 10 at a speed of 60 m/minute after passing through the zinc bath 24. The gas orifice was 0.50 mm and the clearance between the edges 17 and 18 of the filament orifice and the wire 25 was 3.75 mm. Nitrogen was used as the wiping gas at a pressure of 6KPa and a flow rate of 4.5 $m^3$/hr at STP. The wiped wire was found to have a smooth zinc coating free of coating rings and other surface imperfections and with a coating weight of 281 gm/$m^2$. No spattering of zinc onto the nozzle 10 was observed even after many hours of running.

I claim:

1. In a gas jet wiping process for controlling the film applied from the dip coating of a metal filament through a liquid metal bath, the improvement comprising an annular jet wiping nozzle having:

a) an upper annular part having an upper and a lower annular surface meeting in a substantially sharp annular edge, b) a lower annular part having an upper and a lower annular surface meeting in a substantially sharp annular edge, c) an annular gas passage defined between adjacent surfaces of the upper and lower annular parts and terminating between the sharp edges in an annular gas orifice, d) a filament orifice through which the metal filament passes which is defined by the sharp edges and the annular gas orifice, e)

(i) the included angle between the upper surface of the upper annular part and the direction of travel of gas leaving the gas orifice being smaller than $(80-x)°$, and (ii) the included angle between the lower surface of the lower annular part and the direction of travel of gas leaving the gas passage being smaller than $(70+x)°$, where x is a predetermined angle for the gas wiping nozzle and is the included angle between a plane normal to the direction of movement of the filament through the gas jet wiping nozzle and the direction of gas leaving the gas passage, f) the lower surface of the lower annular part directly facing the liquid bath and being so disposed that the minimum included angle between that surface and the direction of movement of the filament through the gas jet wiping nozzle is at least 20°, and g) the upper surface of the upper annular part being so disposed that the minimum included angle between that surface and the direction of movement of the filament through the gas jet nozzle is at least 10°.

2. An apparatus for continuously applying and controlling the thickness of a film applied from the dip coating of a metal filament through a liquid metal bath, comprising:

i) a liquid metal coating bath, ii) a source of pressurized gas, and iii) a gas jet wiping nozzle having:

a) an upper annular part having an upper and a lower annular surface meeting in a substantially sharp annular edge, b) a lower annular part having an upper and a lower annular surface meeting in a substantially sharp annular edge, c) an annular gas passage defined between adjacent surfaces of the upper and lower annular parts and terminating between the sharp edges in an annular gas orifice, d) a filament orifice through which the metal filament passes which is defined by the sharp edges and the annular gas orifice, e)

(i) the included angle between the upper surface of the upper annular part and the direction of travel of gas leaving the gas orifice being smaller than $(80-x)°$, and (ii) the included angle between the lower surface of the lower annular part and the direction of travel of gas leaving the gas passage being smaller than $(70+x)°$, where x is a predetermined angle for the gas wiping nozzle and is the included angle between a plane normal to the direction of movement of the filament through the gas jet wiping nozzle and the direction of gas leaving the gas passage, f) the lower surface of the lower annular part directly facing the liquid bath and being so disposed that the minimum included angle between that surface and the direction of movement of the filament through the gas jet wiping nozzle is at least 20°, and g) the surface of the upper annular part being so disposed that the minimum included angle between that surface and the direction of movement of the filament through the gas get nozzle is at least 10°.

3. A gas jet wiping nozzle for use in controlling the film applied from the dip coating of a metal filament through a liquid metal bath, the nozzle having:

a) an upper annular part having an upper and a lower annular surface meeting in a substantially sharp annular edge, b) a lower annular part having an upper and a lower annular surface meeting in a substantially sharp annular edge, c) an annular gas passage defined between adjacent surfaces of the upper and lower annular parts and terminating between the sharp edges in a annular gas orifice, d) a filament orifice through which the metal filament passes which is defined by the sharp edges and the annular gas orifice, e)

(i) the included angle between the upper surface of the upper annular part and the direction of travel of gas leaving the gas orifice being smaller than $(80-x)^\circ$, and (ii) the included angle between the lower surface of the lower annular part and the direction of travel of gas leaving the gas passage being smaller than $(70+x)^\circ$, where x is a predetermined angle for the gas wiping nozzle and is the included angle between a plane normal to the direction of movement of the filament through the gas jet wiping nozzle and the direction of gas leaving the gas passage, f) the lower surface of the lower annular part directly facing the liquid bath and being so disposed that the minimum included angle between that surface and the direction of movement of the filament through the gas jet wiping nozzle is at least 20°, and g) the surface of the upper annular part being so disposed that the minimum included angle between that surface and the direction of movement of the filament through the gas jet nozzle is at least 10°.

4. A process claimed in claim 1 in which the metal filament is a circular section ferrous wire and the liquid metal coating is zinc, aluminum or an aluminum/zinc alloy.

5. A process as claimed in claim 1 in which the included angle of the upper annular part is less than 80°, preferably less than 50° and more preferably less than 40° and in which the included angle of the lower annular part is less than 70°, preferably less than 50° and more preferably less than 40°.

6. A process as claimed in claim 1 in which the length of the gas passage, in a radial direction, is sufficient to evenly distribute the gas around the filament.

7. A process as claimed in claim 6 in which the gas passage is such that the lower surface of the upper annular part and the upper surface of the lower annular part converge towards one another as they approach the gas orifice, when viewed in radial section, for a distance of at least 2 mm, and preferably at least 6 mm, immediately preceding the gas orifice.

8. A process as claimed in claim 1 in which the gas passage directs gas from the gas orifice at an angle of from +60° to −60° relative to a plane normal to the direction of movement of the filament, preferably +60° to −30° and more preferably +45° to 0°.

9. A process as claimed in claim 1 in which the annular edges of the upper and lower annular parts are so dimensioned as to be spaced from the filament by a distance of less than 10 mm, preferably less than 7.5 mm and more preferably less than 4 mm.

10. A process as claimed in claim 1 in which the gas orifice of the nozzle is space from the surface of the liquid in the bath by a distance of from 10 to 200 mm, preferably 15 to 100 mm.

11. A process as claimed in claim 1 in which the width of the gas passage may be varied by means to allow the relative positions of the upper and lower annular parts to be adjusted axially of the gas jet wiping nozzle.

12. An apparatus as claimed in claim 2 in which the included angle of the upper annular part is less than 80°, preferably less than 50° and more preferably less than 40° and in which the included angle of the lower annular part is less than 70°, preferably less than 50° and more preferably less than 40°.

13. A jet wiping nozzle as claimed in claim 3 in which the included angle of the upper annular part is less than 80°, preferably less than 50° and more preferably less than 40° and in which the included angle of the lower annular part is less than 70°, preferably less than 50° and more preferably less than 40°.

14. An apparatus as claimed in claim 2 in which the length of the gas passage, in a radial direction, is sufficient to evenly distribute the gas around the filament.

15. A gas jet wiping nozzle as claimed in claim 3 in which the length of the gas passage, in a radial direction, is sufficient to evenly distribute the gas around the filament.

16. An apparatus as claimed in claim 14 in which the gas passage is such that the lower surface of the upper annular part and the upper surface of the lower annular part converge towards one another as they approach the gas orifice, when viewed in radial section, for a distance of at least 2 mm, and preferably at least 6 mm, immediately preceding the gas orifice.

17. A gas jet wiping nozzle as claimed in claim 15 in which the gas passage is such that the lower surface of the upper annular part and the upper surface of the lower annular part converge towards one another as they approach the gas orifice, when viewed in radial section, for a distance of at least 2 mm, and preferably at least 6 mm, immediately preceding the gas orifice.

18. An apparatus as claimed in claim 2 in which the gas passage directs gas from the gas orifice at an angle of from +60° to −60° relative to a plane normal to the direction of movement of the filament, preferably +60° to −30° and more preferably +45° to 0°.

19. A jet wiping nozzle as claimed in claim 3 in which the gas passage directs gas from the gas orifice at an angle of from +60° to −60° relative to a plane normal to the direction of movement of the filament, preferably +60° to −30° and more preferably +45° to 0°.

20. An apparatus as claimed in claim 2 in which the annular edges of the upper and lower annular parts are so dimensioned as to be spaced from the filament by a distance of less then 10 mm, preferably less than 7.5 mm and more preferably less than 4 mm.

21. A jet wiping nozzle as claimed in claim 3 in which the annular edges of the upper and lower annular parts are so dimensioned as to be spaced from the filament by a distance of less than 10 mm, preferably less than 7.5 mm and more preferably less than 4 mm.

22. An apparatus as claimed in claim 2 in which the gas orifice of the nozzle is spaced from the surface of the liquid in the bath by a distance of from 10 to 200 mm, preferably 15 to 100 mm.

23. An apparatus as claimed in claim 2 in which the width of the gas passage may be varied by means to allow the relative positions of the upper and lower annular parts to be adjusted axially of the gas jet wiping nozzle.

24. A jet wiping nozzle claimed in claim 3 in which the width of the gas passage may be varied by means to allow the relative positions of the upper and lower annular parts to be adjusted axially of the gas jet wiping nozzle.

* * * * *